United States Patent [19]

Fogarty et al.

[11] 4,318,388

[45] Mar. 9, 1982

[54] LAUNCHING DEVICE USING PINCHING FORCE

[76] Inventors: A. Edward Fogarty; Bonnie R. Fogarty, both of 3513 School Ave., Sarasota, Fla. 33579

[21] Appl. No.: 201,185

[22] Filed: Oct. 27, 1980

[51] Int. Cl.[3] ..... F41B 15/00

[52] U.S. Cl. ..... 124/10; 124/41 R; 273/424

[58] Field of Search ..... 124/10, 79, 41 R, 42, 124/43; 128/321

[56] References Cited

U.S. PATENT DOCUMENTS

| | | | |
|---|---|---|---|
| 1,256,575 | 2/1918 | Koprinski . | |
| 1,502,634 | 7/1924 | Ingebritson . | |
| 2,129,461 | 9/1938 | Boerger . | |
| 2,173,132 | 9/1939 | Piper . | |
| 2,601,070 | 6/1952 | Teschel et al. . | |
| 2,816,536 | 12/1957 | Profitt . | |
| 3,018,584 | 1/1962 | Passariello . | |
| 3,183,903 | 5/1965 | Thompson | 124/10 |
| 3,470,872 | 10/1969 | Grieshaber | 128/321 X |
| 3,487,824 | 1/1970 | Profitt . | |
| 3,711,096 | 1/1973 | Cramp et al. . | |

*Primary Examiner*—Richard C. Pinkham
*Assistant Examiner*—William R. Browne
*Attorney, Agent, or Firm*—Benjamin P. Reese, II

[57] ABSTRACT

A toy device for launching a disk, a ring or a similar circular-shaped toy missile. A pair of opposed, dog-legged arms are pivoted together in an uncrossed relationship. Each of the opposed arms has a first elongated portion with an open channel for engaging the rim of the disk, ring or similar circular-shaped toy missile to be launched and a second elongated portion with a handle for grasping by the user of the toy device. All of the interior surfaces of one of the open channels are relatively smooth. One of the interior surfaces of the other open channel is textured to increase friction when it engages the rim of the disk, ring or similar circular-shaped toy missile to be launched. The coaction of the textured interior surface of one of the open channels and the opposed smooth interior surface of the other open channel on the rim of the circular-shaped toy missile imparts rotational motion to the toy missile as it is impelled forward in the open channels prior to launching.

3 Claims, 4 Drawing Figures

LAUNCHING DEVICE USING PINCHING FORCE

BACKGROUND AND SUMMARY OF THE INVENTION

This invention relates to a toy device for launching a disk, a ring or a similar circular-shaped toy missile.

Various toy devices for launching or projecting toy missiles are well known in the art. Several of the related prior art toy devices are suitable for launching a disk, a ring or a similar circular-shaped toy missile. Examples of such devices can be found in U.S. Pat. No. 2,816,536, issued to L. M. Profitt, for a "Ring Projecting Toy", and U.S. Pat. No. 3,487,824, issued to L. M. Profitt, for a "Toy Gun for Projecting Reverse Spinning Ring-Like Missiles".

While the devices disclosed in U.S. Pat. Nos. 2,816,536 and 3,487,824 are relatively simple to use, both of these devices comprise relatively complex projecting mechanisms which depend upon the force exerted by a leaf spring for their operation. And, of course, it is always possible that a small child would be harmed by such a mechanism. Furthermore, attractive toy devices embodying the concepts taught in U.S. Pat. Nos. 2,816,536 and 3,487,824 are relatively difficult to manufacture.

It is desirable to have a toy device for launching a disk, a ring or a similar circular-shaped toy missile which minimizes the risk of harm to small children and others who use the device. It is also desirable to have such a toy device which is both simple to use and simple to manufacture. Preferably, such a toy device would be capable of manufacture by casting or molding a limited number of components or structural elements from a suitable plastic material. A prior art device which satisfies many of these requirements is disclosed in U.S. Pat. No. 3,711,096, issued to Cramp, et al., for a "Projecting Apparatus and Projectile for Use Therewith". But, that device is only suitable for projecting a specialized toy missile having two conical elements connected by an axle pin.

The present invention provides a toy device for launching a disk, a ring or similar circular-shaped toy missile which minimizes the risk of harm to small children and others who use the device. The toy device is both simple to use an simple to manufacture. The toy device can be cast or molded from a suitable plastic material.

The toy device of the present invention comprises a pair of opposed dog-legged arms pivoted together in an uncrossed relationship. Each of the opposed arms has a first elongated portion with an open channel which engages the rim of the disk, ring or other similar circular-shaped toy missile to be launched. And, each of the arms has a second elongated portion positioned at an angle to its first elongated portion. A handle is provided on the free end of the second elongated portion of each arm.

With the first elongated portions of the arms in a spread-apart configuration, the disk, ring or similar circular-shaped toy missile to be launched is placed in the opposed, open channels near the pivotal interconnection of the arms. The user of the toy device grasps the handles and rapidly moves them into a spread-apart configuration. The second elongated portions of the arms move the first elongated portions into a close-spaced configuration. The resulting force on the rim of the disk, ring or other similar circular-shaped toy missile impels the toy missile outward from its position of rest in the opposed, open channels. A textured interior surface in one of the opposed, open channels engages one side of the rim of the circular-shaped toy missile and a relatively smooth interior surface in the other channel engages the opposite side of the rim to impart rotational motion to the toy missile. When the toy missile reaches the free ends of the first elongated portions of the arms, it is expelled from the open ends of the channels for a spinning flight.

These and many other advantages, features and objects of the present invention will be apparent from the following Brief Description of Drawings, Description of the Preferred Embodiment and claims.

DETAILED DESCRIPTION OF THE PREFERRED EMBODIMENT

The preferred embodiment of the toy device of the present invention is illustrated in FIGS. 1–4.

In its preferred embodiment, the toy device of the present invention comprises a pair of opposed, dog-legged arms 10 and 10' pivoted together in an uncrossed relationship. Preferably, each of the arms 10 and 10' is cast or molded from a suitable plastic material. The present invention is not limited, however, by either the materials used to fabricate the arms 10 and 10', or any other component of the toy device, or the methods used for such fabrication.

Figure 3:
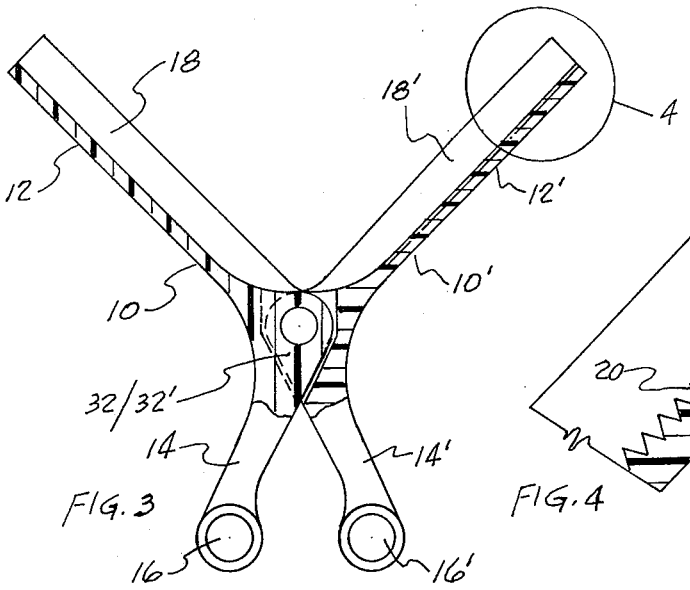
FIG. 3 is a cross-sectional view of the toy device taken along Line 3—3 in FIG. 2, but illustrating both arms of the device.

Referring to FIG. 3, each of the arms 10 and 10' has a first elongated portion 12 and 12' for engaging the rim of a disk, a ring or a similar circular-shaped toy missile and a second elongated portion 14 and 14', positioned at an angle to the first elongated portion 12 and 12', to function as a lever for movement of the first elongated portion 12 and 12' during operation of the toy device. Each of the second elongated portions 14 and 14' is provided with a handle 16 and 16' on its free end for grasping and holding by the person operating the toy device. Preferably, the first elongated portions 12 and 12' of the arms 10 and 10' are longer than the second elongated portions 14 and 14'.

An open channel 18 and 18' having an essentially U-shaped cross section is provided along the entire length of each of the first elongated portions 12 and 12' of the arms 10 and 10'. Each of the channels 18 and 18' is positioned with its elongated opening on its side and in direct opposition to the elongated opening of the other. Furthermore, the end of each of the channels 18 and 18' which is located nearest the pivotal interconnection of the arms 10 and 10' is closed and the opposite or free end of each of the channels 18 and 18' is open. One of the channels 18 has relatively smooth interior surfaces to reduce friction when the channel 18 contacts the surfaces of the disk, ring or similar circular-shaped toy missile to be launched. The upper and lower interior surfaces of the other channel 18' are relatively smooth, but the interior surface which is parallel to the elongated opening of the channel 18' is textured to increase friction between that surface and the rim of the disk, ring or similar circular-shaped toy device to be launched.

Figure 4:
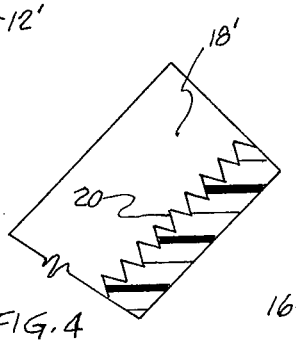
FIG. 4 is an enlarged view of Area 4 in FIG. 3 further illustrating the textured interior surface of the channel in that arm of the toy device.
Figure 2:
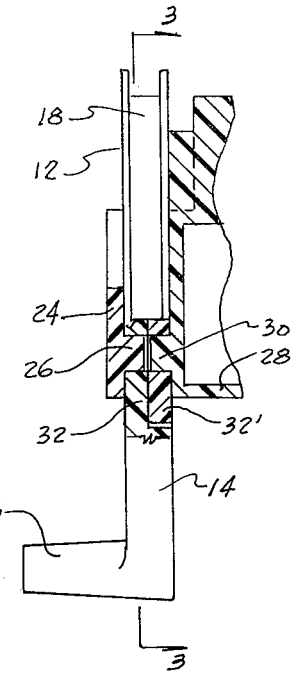
FIG. 2 is a detailed view, in partial cross section, of one arm of the toy device looking into the channel in one face of the arm and illustrating the means for connecting the arm to the ornamental support base shown in FIG. 1.
Figure 1:
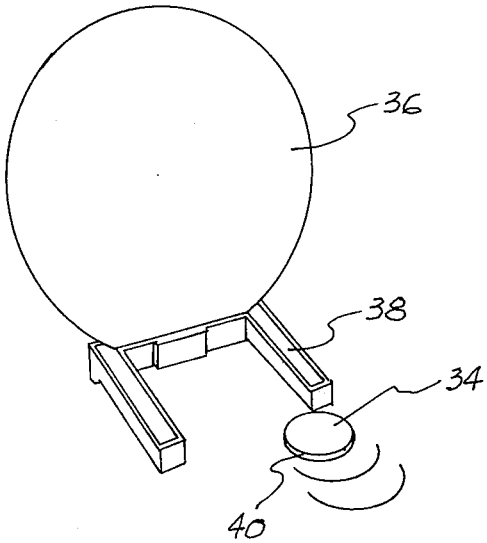
FIG. 1 is a perspective view of one embodiment of the toy device of the present invention in combination with an ornamental support base shown with a toy disk and a circular-shaped target.
Figure 1:
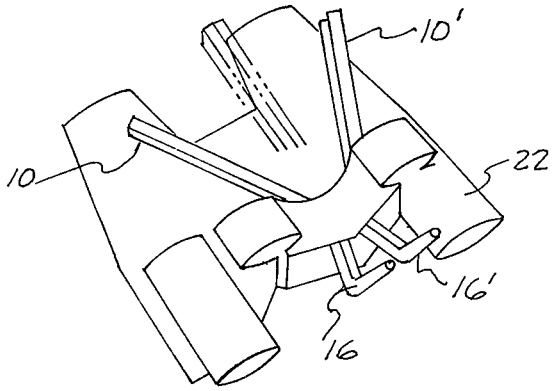

As illustrated in FIG. 4, the appropriate interior surface of the channel 18' can be textured by providing parallel grooves 20 positioned at right angles to the longitudinal axis of the channel 18'. Of course, other conventional surface texturing means can be utilized without departing from the spirit and scope of the present invention. For example, a plurality of small dimples or protrusions could be provided on the appropriate interior surface when the arm 10' is cast or molded. Alternatively, a strip of a suitable material having a textured surface, such as texturized rubber, could be affixed to the appropriate interior surface by conventional means, such as cementing, after the arm 10' is cast or molded.

If the toy device of the present invention is to be used without a support base, a conventional pivot pin, or other conventional means, can be used to pivotedly interconnect the opposed arms 10 and 10'. If the toy device is to be used in combination with a support base, it is preferable to provide the means for pivotedly interconnecting the opposed arms 10 and 10' as an inherent feature of the support base. For example, the ornamental support base 22 illustrated in FIGS. 1 and 2 has an upper element 24 with a cylindrical protrusion 26 and a lower element 28 with a cylindrical protrusion 30. The cylindrical protrusions 26 and 30 are positioned in axially aligned, cylindrical openings through the overlapped, dog-legged portions 32 and 32' of the opposed arms 10 and 10'. To complete assembly of the toy device-support base structural combination, the upper element 24 and the lower element 30 of the support base 22 are fastened together by conventional means, such as nuts and bolts. It will be readily appreciated that the cylindrical protrusion 26 of the upper element 24 and the cylindrical protrusion 30 of the lower element 28, when positioned in the end-to-end relationship which is illustrated, are functionally equivalent to a conventional pivot pin.

Having described the structure of the preferred embodiment of the toy device of the present invention, the preferred means for operating and using that toy device will now be described. Again, referring to FIG. 1, the toy device is illustrated in combination with an ornamental support base 22. Preferably, the toy device in used for launching a disk 34 in the general direction of a target 36. The target 36 can be suspended from a wall or other suitable location by conventional means or positioned on a table or other horizontal surface with a conventional support base 38. For the toy device to achieve its maximum operational effectiveness, the rim 40 of the disk 34 should be provided with a textured surface. If desired, this can be accomplished by affixing a strip of bristly material, such as Velcro, around the rim 40 of the disk 34. If a bristly material is affixed to the rim 40 and the target 36 is covered with a suitable cloth material, the disk 34 will adhere to the target 36 upon impact.

When it is desired to launch the disk 34 with the toy device, the opposed arms 10 and 10' are positioned such that their first elongated portions 12 and 12' are in a spread-apart configuration. The rim 40 of the disk 34 is inserted in the channels 18 and 18' and the disk 34 is positioned near the closed ends of the channels 18 and 18', i.e. adjacent to the pivotal interconnection of the arms 10 and 10'. Grasping one of the handles 16 and 16' with his or her left hand and the other handle 16 and 16' with his or her right hand, the person operating the toy device rapidly moves the handles 16 and 16' into a spread-apart configuration. As the handles 16 and 16' are moved, the second elongated portions 14 and 14' of the arms 10 and 10' function as levers to move the first elongated portions 12 and 12' into a close-spaced configuration. As the first elongated portions 12 and 12' of the arms 10 and 10' are moved into their close-spaced configuration, the disk 34 is forced outward from its position of rest near the pivotal interconnection of the arms 10 and 10'. Simultaneously, the coaction of the textured interior surface of one channel 18' engaging one side of the rim 40 of the disk 34 and the opposed smooth interior surface of the other channel 18 engaging the opposite side of the rim 40 impart rotational motion to the disk 34. As the disk 34 moves outward from its position of rest, both its linear momentum and rotational momentum are increased. When the disk 34 has been impelled to the free ends of the first elongated portions 12 and 12' of the arms 10 and 10', it is expelled from the open ends of the channels 18 and 18' for a spinning flight toward the target 36.

While the operation and use of the toy device to launch a toy disk has been described, it will be readily appreciated that an annulus, a ring, a toroid or any other similar circular-shaped toy missile can be launched with the toy device. Furthermore, many toy missiles which are not exactly circular-shaped can be launched with the toy device. Preferably, the toy missile to be launched with the toy device is cast or molded from a suitable lightweight, plastic material. Other suitable lightweight materials can be used to fabricate the toy missile, however.

While the present invention has been disclosed in connection with the preferred embodiment thereof, it should be understood that there may be other embodiments which fall within the scope and spirit of the invention as defined by the claims.

We claim:

1. A toy device for launching a disk, a ring or a similar circular-shaped toy missile, comprising:

(a) a pair of opposed, dog-legged arms, each of said arms having a first elongated portion with an open channel for engaging the rim of the disk, ring or similar toy missile to be launched and a second elongated portion, positioned at an angle to said first elongated portion, with handle for operation of the toy device; and (b) a support base having an upper element with a cylindrical protrusion and a lower element with a cylindrical protrusion, said cylindrical protrusions being positioned end-to-end in axially aligned, cylindrical openings through overlapped, dog-legged portions of said arms such that said arms are pivoted together in uncrossed relationship.

2. A toy device as recited in claim 1, wherein said open channel in one of said arms has smooth interior surfaces and said open channel in the other of said arms has one interior surface which is textured to increase friction between said interior surface and the rim of the disk, ring or similar circular-shaped toy missile to be launched.

3. A toy device as recited in claim 2, wherein said interior surface which is textured has parallel grooves positioned at right angles to the longitudinal axis of said open channel.

* * * * *